US007824542B2

(12) United States Patent
Menzel

(10) Patent No.: US 7,824,542 B2
(45) Date of Patent: Nov. 2, 2010

(54) PROCESS FOR ENHANCEMENT OF THE SELECTIVITY OF PHYSICALLY ACTING SOLVENTS USED FOR THE ABSORPTION OF GAS COMPONENTS FROM INDUSTRIAL GASES

(75) Inventor: Johannes Menzel, Waltrop (DE)

(73) Assignee: UHDE GmbH, Dortmund (DE)

( * ) Notice: Subject to any disclaimer, the term of this patent is extended or adjusted under 35 U.S.C. 154(b) by 398 days.

(21) Appl. No.: 11/883,522

(22) PCT Filed: Jan. 12, 2006

(86) PCT No.: PCT/EP2006/000208

§ 371 (c)(1),
(2), (4) Date: Aug. 1, 2007

(87) PCT Pub. No.: WO2006/081921

PCT Pub. Date: Aug. 10, 2006

(65) Prior Publication Data

US 2008/0314801 A1 Dec. 25, 2008

(30) Foreign Application Priority Data

Feb. 2, 2005 (DE) ..... 10 2005 004 948

(51) Int. Cl.
*C10G 5/04* (2006.01)
*B01D 53/02* (2006.01)

(52) U.S. Cl. ..... 208/341; 208/342; 208/343; 208/344; 208/346; 423/226; 423/228

(58) Field of Classification Search ..... 208/343, 208/342, 341, 345, 346
See application file for complete search history.

(56) References Cited

U.S. PATENT DOCUMENTS

| | | | | |
|---|---|---|---|---|
| 2,813,126 | A | 11/1957 | Tierney | |
| 3,205,164 | A * | 9/1965 | Brown | 208/236 |
| 3,473,903 | A * | 10/1969 | Dille et al. | 48/212 |
| 3,490,865 | A * | 1/1970 | Huxley | 423/229 |
| 3,656,887 | A * | 4/1972 | Suzuki et al. | 423/226 |
| 4,085,192 | A * | 4/1978 | Van Scoy | 95/179 |
| 6,368,385 | B1 * | 4/2002 | Paradowski | 95/181 |
| 6,508,863 | B1 * | 1/2003 | Byrne et al. | 95/143 |
| 7,373,790 | B2 * | 5/2008 | Clare et al. | 62/621 |
| 2007/0077188 | A1 | 4/2007 | Katz et al. | |
| 2007/0227355 | A1 | 10/2007 | Menzel | |

FOREIGN PATENT DOCUMENTS

| | | | |
|---|---|---|---|
| DE | 103 52 878 | A1 | 6/2005 |
| EP | 1 201 290 | A1 | 5/2002 |
| WO | WO 2005/054412 | A1 | 6/2005 |

OTHER PUBLICATIONS

"Une premiere en offshore: Le Procede Elf Aquitaine De Desulfuration Selective Du Gaz Associe"; Petrole Informations, No. 1681ARIS, FR; NR. 1681, Dec. 1991; p. 66, XP000241599) Paris, France.

* cited by examiner

*Primary Examiner*—Tam M Nguyen
(74) *Attorney, Agent, or Firm*—Marshall & Melhorn, LLC

(57) ABSTRACT

The invention relates to a method for recovering absorbed hydrocarbon components while absorbing acid gases from technical gases, as for example a natural gas, by means of physically active absorption agents, wherein the inventive method consists in increasing the pressure of a loaded absorption agent extracted from an adsorption device, in adding said loaded absorption agent to the top of a rectification column which consist of a lower feeding stove and of one or several lateral stoves operating at a pressure slightly greater than the absorption column pressure, in adjusting an equilibrium is said rectification column in such a way that the acid gas concentration in the absorbent agent increases in the direction away from the bottom of the column and the hydrocarbon concentration decreases in said direction, in extracting a heated hydrocarbon-poor and acid gas component-rich absorption agent from the bottom of the column and in transferring said agent to an acid gas desorption device, in extracting a hydrocarbon-poor and acid gas component-rich recycling gas from the top of the rectification column, in cooling said recycling gas in a recycling gas cooler to a temperature of a service gas directed in the absorption device and in transferring said recycling gas directly to the absorption device or in mixing it with the service gas.

3 Claims, 1 Drawing Sheet

Figure 1:
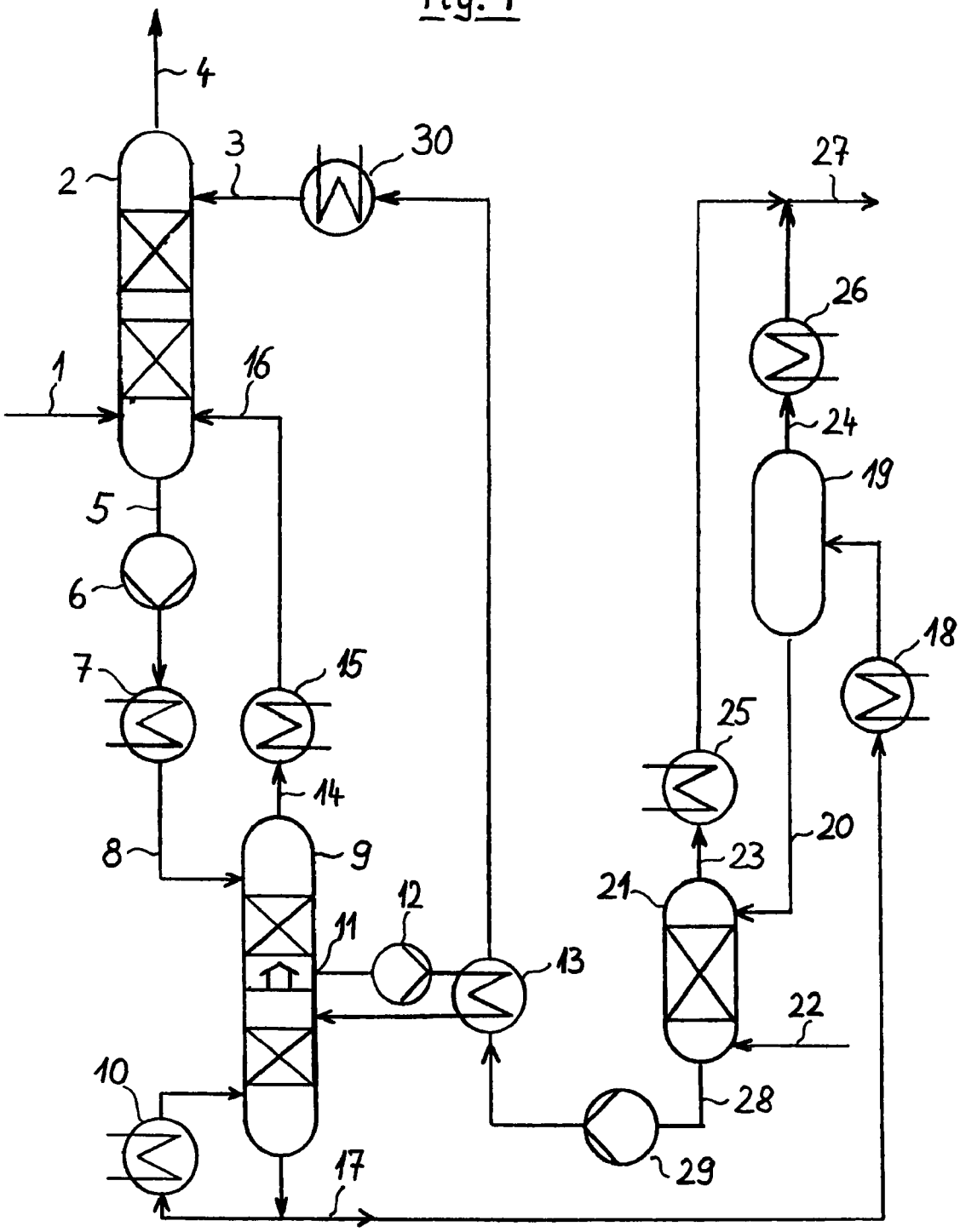

PROCESS FOR ENHANCEMENT OF THE SELECTIVITY OF PHYSICALLY ACTING SOLVENTS USED FOR THE ABSORPTION OF GAS COMPONENTS FROM INDUSTRIAL GASES

The invention relates to a process for enhancement of the selectivity of physically acting solvents used for the absorption of gas components from industrial gases. Here are some examples of such absorptions:

absorption of sour gases from crude natural gas,
absorption of sour gases from raw synthesis gas,
absorption of carbon dioxide from natural gas,
absorption of carbon dioxide from synthesis gas,
absorption of ammonia.

In most cases, however, the physically acting solvent also separates useful components from the industrial gas. Especially if stringent requirements are specified for the final purity of industrial gases, the operational conditions to be satisfied with regard to the components to be removed must be adjusted in such a manner that the amount of co-absorbed useful components cannot be neglected, which constitutes an inevitable disadvantage of any such physically acting solvent.

Therefore, it is common practice to perform expensive recovery methods prior to the regeneration of the physically acting solvent. Typical examples of such state-of-the-art recovery methods are:

recovery of carbon dioxide,
recovery of hydrocarbon compounds and hydrogen.

The recovery processes are combined with a correspondingly designed absorption device. The said absorption devices are utilized for crude natural gases or synthesis gases, which contain, in addition to useful components such as methane, higher hydrocarbons, hydrogen, carbon dioxide—to the extent desired—and carbon monoxide, impurities such as hydrogen sulphide, organic sulphur components such as mercaptan and carbon oxide sulphide and also—if undesired—carbon dioxide and small amounts of water vapour in various different portions. The compounds thus recovered are either re-usable for addition to the respective purified industrial gas or for being commercialised as separate product.

As a rule, it is necessary to reduce, for example, the sulphur components contained in crude natural gas to a given ppm content in order to permit further technical exploitation. The removal of hydrogen sulphide, mercaptans, carbon dioxide and other sour gas components from industrial gases is generally effected with the aid of chemically acting absorbents such as amine solutions, alkali salt solutions, etc., or physically acting absorbents such as Selexol, propylene carbonate, n-methyl-pyrrolidon, Morphysorb, methanol, etc., circulated in a loop system, physically acting absorbents being capable—contrary to chemically acting absorbents—of removing organic sulphur components, too. Depending on the target or task involved, the carbon dioxide contained in the gas is removed completely, in part or in quantities as small as possible.

As physically acting absorbents also co-absorb, as a rule, a certain portion of hydrocarbons during the removal of sour gas components from industrial gases, the solution leaving the absorber is normally depressurised prior to the desorption of the sour gases into a recycle flash vessel to a pressure lower than that of the absorption step, the released flash gas being re-compressed by means of a recycle compressor and added to the input gas as recycle gas for further purification before the absorption step. When being treated with physically acting absorbents, all higher hydrocarbons exhibit a problematic property, i.e. their solubility in the physically acting absorbent is enhanced in relation to the number of carbon atoms.

This means that in the case of a simple flash step, lower hydrocarbons tend to be easily removable but higher hydrocarbons tend to be difficult to be removed from the absorbent by flashing. If the higher hydrocarbons must also be recovered prior to the absorbent regeneration itself, it may be necessary to provide several flash steps with major pressure reductions which, however, will also effect an early desorption of larger amounts of sour gases which consequently will also have to re-compressed. The said problem becomes even more serious if, for example, in the case of purification of crude natural gas, the extracted gas contains, apart from a large sour gas portion, a particularly high portion of ethane, propane as well as further higher hydrocarbons.

Hence, it is detrimental to the process design that it is necessary to provide a sophisticated system of flash steps with major pressure reductions prior to the absorbent regeneration itself,
an expensive recycle compressor must be installed and on account of the larger gas quantities and larger pressure difference, the operation of the said unit requires a major energy input, and
the absorption device must be larger rated by the amount of the recycled volume to cope with the re-compressed recycle gas in view of both the forcedly co-flashed sour gases and the gas volume.

Therefore, the objective of the invention is to provide a process for recovering hydrocarbon compounds co-absorbed in the absorption of sour gases from industrial gases such as natural gas, using physically acting absorbents and the said process featuring the following criteria:

avoidance of major pressure reductions below the absorption pressure,
configuration without recycle gas compressor if feasible, and
returning of as small a quantity of laden recycle gas as possible to the absorption section so that the absorption device need not be rated for larger volumes.

The objective of the invention is achieved as follows:

First an increase in pressure of the laden absorbent withdrawn from the absorption device is effected;
the laden absorbent is subsequently fed to the head of a stripping column equipped with a bottom reboiler and one or several side boilers and operated at a pressure slightly higher than that in the absorption column;
an equilibrium is obtained in the said stripping column by controlling the bottom reboiler and the feed temperature in such a manner that the sour gas concentration of the absorbent increases on its way to the column bottom whereas the concentration of the hydrocarbons declines on their way to the column bottom;
heated absorbent that has a low hydrocarbon content but is rich in sour gas components is withdrawn from the column bottom and fed to a sour-gas desorption device;
recycle gas that is rich in hydrocarbons but which has a low content of sour gas components is withdrawn from the head of the stripping column;
the recycle gas is cooled in a recycle gas cooler to the temperature of the input gas fed to the absorption device and then the said recycle gas is either fed directly to the absorption device or added to the input gas.

The recycle gas withdrawn at the head of the stripping column is deemed to have a low content of sour gas components within the meaning of this invention if and when the sour gas content is below 50%.

Contrary to a state-of-the-art configuration with flash steps and recycle gas compressor, the solution described herein also has the advantage that the quantity of recovered hydrocarbons by far exceeds the respective amount feasible up to now.

In an embodiment of the process in accordance with the invention, the temperature of the laden absorbent leaving the absorption device is changed before its entry into the stripping column, i.e. an increase or a decrease in temperature is feasible. It is recommended that a device for indirect heat exchange be used, the device being suited to operate with either a cooling or a heating fluid.

The laden absorbent is cooled during plant operation if a higher separation performance of the stripping column is required. This applies whenever a lower sour gas portion in the recycle gas or a lower hydrocarbon portion in the effluent withdrawn at the column bottom or both is desired. The cooling performance, hence, equals that of a reflux cooler for the stripping column so that consequently a cooler can be dispensed with. In fact, this method also leads to an increase in the heat required for the stripping column reboilers.

The laden absorbent is heated during plant operation when the physically acting absorbent has co-absorbed a large amount of lower hydrocarbons (primarily methane), which are easily desorbed and can be flashed in the stripping column head.

The pressure rise during the heating cycle can best be effected by means of a pump. In case of operation without any heating, it is also possible to obtain the higher pressure level required in the stripping column by static pressure at different height levels, i.e. placing the absorption device at a higher level than that of the stripping column in such a manner that the liquid column obtained in the liquid feed lines equals the pressure difference that is sufficient for conveying the recycle gas to the absorption device.

If it is intended to apply the process described in the present invention to recover such hydrocarbons that have been absorbed from the crude natural gas, this method also provides the possibility and a certain degree of freedom to adjust an economical optimum for the recovery whenever there is a cyclic variation in the absorbed gas portions, which also constitutes a benefit of the present invention.

The invention is hereinafter illustrated on the basis of flow sheet FIG. 1 which shows the process in accordance with the invention and the related equipment: a stripping column with the necessary pumps and heat exchangers, their interaction with an absorption column and a two-step sour gas desorption device.

Input gas 1 is fed to the bottom part of absorption column 2 and flows upwards through the said column, thereby being scrubbed by regenerated physically acting absorbent 3 introduced at the column top and being freed from sour gases. Purified gas 4 leaves absorption column 2 via the head.

Absorbent 5 laden with sour gases, which also includes co-absorbed hydrocarbons, is withdrawn from the bottom of absorption column 2 and then pressurised by pressurising pump 6 to an elevated pressure and heated or cooled in heat exchanger 7 depending on the specific operational requirements. Laden absorbent 8 that has undergone a change in temperature and pressure is fed to the head of stripping column 9 and passes through the packings or trays of this column 9 from top to bottom, whereas the desorbed gases flow upwards in a counter-current stream.

The absorbent merely bearing sour gas is withdrawn at the bottom of stripping column 9 and part of the adsorbent is heated in reboiler 10, part of the sour gases that support the stripping action in the lower part of stripping column 9 being desorbed thereby. In order to provide for a low-energy desorption of the sour gases, it is recommended that not all of the heat required in the bottom reboiler be fed but instead via one or several side boilers which are supplied with the necessary energy by way of a heat exchange with the hot regenerated solution originating from the desorber. Therefore, lateral outlet 11 is installed in the centre part of the stripping column and serves for withdrawing the laden absorbent by means of lateral outlet pump 12, the said pump being used to feed the stream to side boiler 13 and to recycle it to stripping column 9.

Recycle gas 14, which is rich in hydrocarbons but has a low content of sour gas components, is withdrawn via the head of stripping column 9, cooled in cooler 15 and recycled to absorption column 2. For this reason the operating pressure in stripping column 9 is adjusted in such a manner that the pressure gradient between the head of stripping column 9 and feed point 16 of absorption column 2 ensures a secure conveying of recycle gas 14. In this connection, the choice of feed point 16 depends on the concentration of sour gas components whose value measured at the chosen feed point should approximately equal that at the chosen feed point in absorption column 2 as well as that of recycle gas 14.

Absorbent 17 laden with sour gas and withdrawn from stripping column 9 is further heated in heater 18 and piped to medium-pressure flash vessel 19 in which a major depressurisation takes place, thereby desorbing a major part of sour gas 24. Partly desorbed absorbent 20 is subsequently sent to low-pressure stripper 21 in which a further depressurisation takes place and effects an almost complete removal of the remaining sour gases 27 from the absorbent with the aid of a gaseous stripping agent 22, such as $CO_2$ or $N_2$. Desorbed sour gases 23 and 24 are cooled in sour gas coolers 25 und 26 and mixed to form sour gas stream 27, the latter being provided for further applications. An alternative configuration also permits a complete regeneration in a desorption column without external feed of stripping gas, the regeneration in this case taking place in a bottom reboiler supplying the necessary stripping steam.

Regenerated absorbent 28 is first piped by pump 29 to side boiler 13 in which it is used as heating agent and then to cooler 30, in which it is heated to the specified absorption temperature, and subsequently it is sent as regenerated absorbent 3 to the head of absorption column 2. If further heat consumers must be serviced, it is of course possible to operate further heat applications, for example, bottom reboiler 10 and heat exchanger 7 can be supplied with waste heat.

In order to provide a better outline of the advantages, the design calculation example shown in Table 1 serves to substantiate the features, the numbers corresponding to the key to referenced items in FIG. 1. The absorbent applied was a mixture of n-formylmorpholine and n-acetylmorpholine in accordance with the application in the Morphysorb process.

TABLE 1

| Stream | Temperature [° C.] | Pressure [bar] | Methane [kmol/h] | $H_2S$ Sour gas [kmol/h] | Hydrocarbons $C2^+$ [kmol/h] | Others ($CO_2$, $N_2$, etc.) [kmol/h] | Absorbent [kmol/h] |
|---|---|---|---|---|---|---|---|
| 1 | 50 | 67.5 | 5470 | 1944 | 2004 | 580 | — |
| 4 | 16 | 67 | 5470 | 0.02 | 1987 | 543 | — |
| 5 | 60 | 67 | 300 | 2321 | 623 | 238 | 4719 |
| 8 | 85 | 70 | 300 | 2321 | 623 | 238 | 4719 |
| 14 | 92 | 68 | 300 | 376 | 608 | 189 | — |
| 17 | 184 | 68 | — | 1944 | 15.7 | 49 | 4718 |
| 22 | 100 | 10 | — | — | — | 300 | — |
| 27 | 50 | 5 | — | 1944 | 15.7 | 338 | — |
| 28 | 174 | 5 | — | 0.003 | — | — | 4718 |

A plant of conventional design was calculated in an example of comparison. Table 2 compares streams 14 and 27 of the a/m calculation example with those of the example in Table 2, relevant items being V marked.

TABLE 2

| Stream | Temperature [° C.] | Pressure [bar] | Methane [kmol/h] | $H_2S$ Sour gas [kmol/h] | Hydrocarbons $C2^+$ [kmol/h] | Others ($CO_2$, $N_2$, etc.) [kmol/h] | Absorbent [kmol/h] |
|---|---|---|---|---|---|---|---|
| 14 | 92 | 68 | 300 | 376 | 608 | 189 | — |
| 14 V | 45 | 9 | 317 | 900 | 458 | 196 | — |
| 27 | 50 | 5 | — | 1944 | 15.7 | 338 | — |
| 27 V | 50 | 5 | 10 | 1944 | 167 | 361 | — |

The comparison reflects that the application of the process in accordance with the present invention reduces the hydrocarbon losses by factor 10, which constitutes a benefit of the process described in this invention. The a/m example substantiates a gain of approx. 100 MW of thermal power which would be lost in a conventional process (recycle flash) via the sour gas. Moreover, a recycle compressor of approx. 3.5 MW electric power is needed for the conventional process whereas the process described in this invention requires no such machine.

KEY TO REFERENCED ITEMS

1 Input gas
2 Absorption column
3 Regenerated absorbent
4 Purified gas
Laden absorbent
6 Pressurising pump
7 Heat exchanger
8 Laden absorbent
9 Stripping column
10 Reboiler
11 Lateral outlet
12 Lateral outlet pump
13 Side boiler
14 Recycle gas
15 Cooler
16 Feed point
17 Laden absorbent
18 Heater
19 Medium-pressure flash vessel
20 Partly desorbed absorbent
21 Low-pressure stripper
22 Stripping agent
23 Desorbed sour gas
24 Desorbed sour gas
25 Sour gas cooler
26 Sour gas cooler
27 Sour gas
28 Regenerated absorbent
29 Pump
30 Cooler

The invention claimed is:

1. Process for recovering hydrocarbon compounds co-absorbed in the absorption column of sour gases from industrial gases such as natural gas, using physically acting absorbents, comprising:

withdrawing a laden absorbent from the absorption column;

increasing the pressure of the laden adsorbent;

subsequently feeding the laden absorbent to the head of a stripping column equipped with a bottom reboiler and one or several side boilers and which is operated at a pressure slightly higher than that in the absorption column;

obtaining an equilibrium in the stripping column by controlling in a manner that the sour gas concentration of the absorbent increases on its way to the column bottom whereas the concentration of the hydrocarbons declines on their way to the column bottom;

withdrawing heated absorbent that has a low hydrocarbon content and is rich in sour gas components from the column bottom and fed to a sour-gas desorption device;

withdrawing a recycle gas that is rich in hydrocarbons and has a low content of sour gas components from the head of the stripping column;

cooling the recycle gas in a recycle gas cooler to the temperature of the input gas fed to the absorption column and the recycle gas is either fed directly to the absorption column or added to the input gas.

2. Process according to claim 1, wherein the temperature of the laden absorbent leaving the absorption column is changed before its entry into the stripping column.

3. Process according to claim 2, wherein a device for indirect head exchange is used, the device being suited to operate with either a cooling or a heating fluid.

* * * * *